United States Patent [19]

Lense et al.

[11] 4,199,058

[45] Apr. 22, 1980

[54] PACKAGE

[75] Inventors: Robert F. Lense, Rockford, Ill.; Joseph R. Kuehn, Cross Plains, Wis.

[73] Assignee: Amerock Corporation, Rockford, Ill.

[21] Appl. No.: 970,318

[22] Filed: Dec. 18, 1978

[51] Int. Cl.[2] ..... B65D 5/32

[52] U.S. Cl. ..... 206/45.14

[58] Field of Search ..... 206/45.14, 45.31, 459, 206/467, 515

[56] References Cited

U.S. PATENT DOCUMENTS

| | | | |
|---|---|---|---|
| 2,493,103 | 2/1970 | Cate | 206/45.31 |
| 2,743,862 | 5/1956 | Paige | 206/45.31 |
| 3,148,103 | 9/1964 | Gallagher | 206/459 |
| 3,358,819 | 12/1967 | Johnson | 206/45.14 |
| 3,659,704 | 5/1972 | Callura . | |

*Primary Examiner*—Herbert F. Ross

*Attorney, Agent, or Firm*—Leydig, Voit, Osann, Mayer & Holt, Ltd.

[57] ABSTRACT

A package comprising a molded plastic base with an upstanding peripheral section and a transparent cover having a skirt which telescopes the peripheral section and is secured to the latter to enclose an article to be packaged. A tab is molded integrally with the base at one edge of the peripheral section and is connected to the base by a fold line so that the tab may either project from the base for use in hanging the package or be folded under the base to permit a plurality of packages to be stacked one on top of the other. A sheet with identifying indicia extends across the fold line and has a portion secured to the tab and a portion secured to the adjacent side of the peripheral section so that the article may be identified whether the package is hung or stacked.

2 Claims, 6 Drawing Figures

PACKAGE

BACKGRDUND OF THE INVENTION

This invention relates to a package comprising a molded plastic base and a transparent cover having a skirt which telescopes the base and is secured to the latter to enclose an article to be packaged.

SUMMARY OF THE INVENTION

The general object of the invention is to provide a new and improved package of the foregoing type which permits the packaged article to be identified readily whether the packages are hung on a display rack or stacked one on top of the other.

A more detailed object is to achieve the foregoing by providing the base with an upstanding peripheral section and a tab connected to the latter by a fold line whereby the tab may either project from the base and be used for hanging the package or may be folded under the base to permit the package to be stacked.

A further object is to provide a sheet containing identifying indicia with the sheet extending across the fold line and having one portion secured to the tab and another portion secured to the adjacent side of the peripheral section.

The invention also resides in the novel construction of the base for supporting the packaged article.

DETAILED DESCRIPTION OF THE PREFERRED EMBODIMENT

Figure 3:
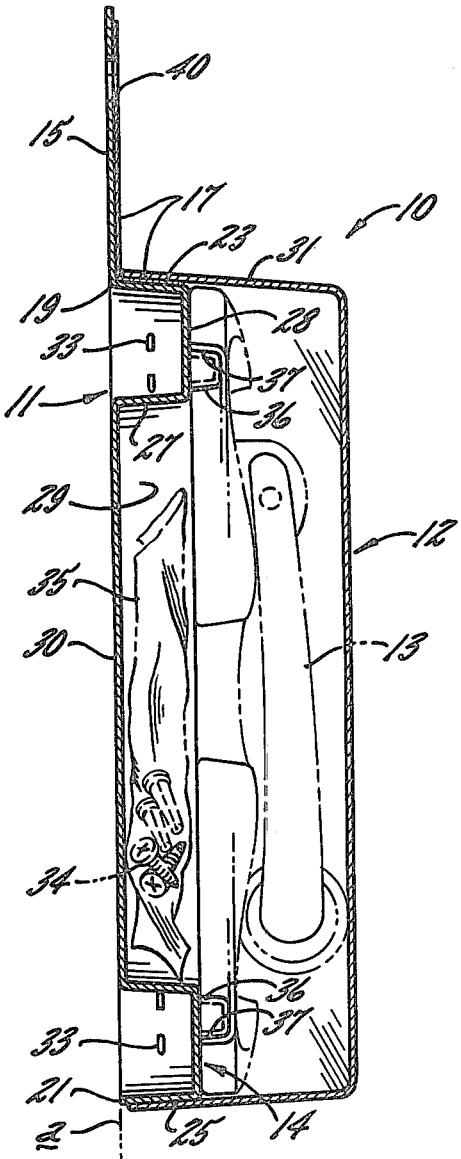
FIG. 3 is an enlarged sectional view taken along the line 3—3 in FIG. 1.
Figure 6:
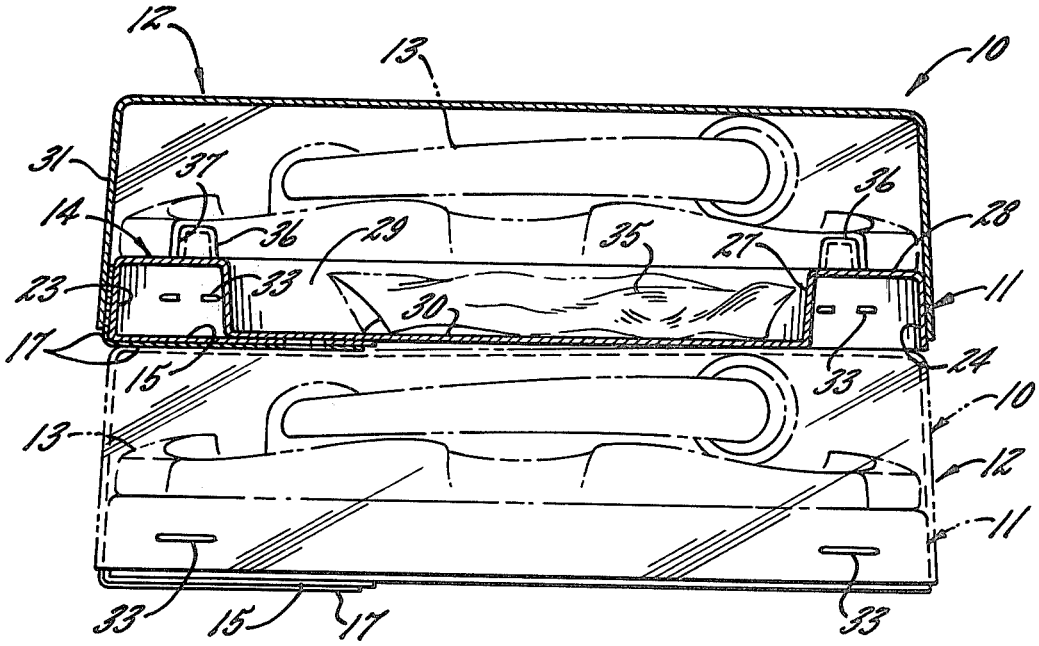
FIG. 6 is an enlarged sectional view taken along the line 6—6 in FIG. 5 and showing an additional package to illustrate the manner in which the packages are stacked.

As shown in the drawings for purposes of illustration, the invention is embodied in a package 10 which comprises a molded plastic base 11 and a transparent cover 12 enclosing an article 13 to be packaged. In accordance with the present invention, the base and the cover are constructed and coact in a novel manner so that the article 13 contained in the package may be readily identified whether the package is hung on a display rack or stacked compactly with other similar packages. To this end, the base 11 is formed to lie in a plane a (FIG. 3) with a peripheral section 14 upstanding from the margin of the base and with a tab 15 projecting from one edge of the base and normally lying in the plane a. The transparent cover 12 telescopes with and is fastened to the peripheral section to enclose the article. A fold line 16 (FIGS. 1 and 2) is formed between the inner end of the tab and the adjacent edge of the base so that the tab may be folded in under the base. As a result, the package may either be hung by the tab for display or, with the tab folded under, be stacked on similar packages as illustrated in FIG. 6. Means 17 are provided on the tab and on the adjacent part of the peripheral section 14 to identify the packaged article whereby the article may readily be identified whether the package is hung or stacked.

Figure 4:
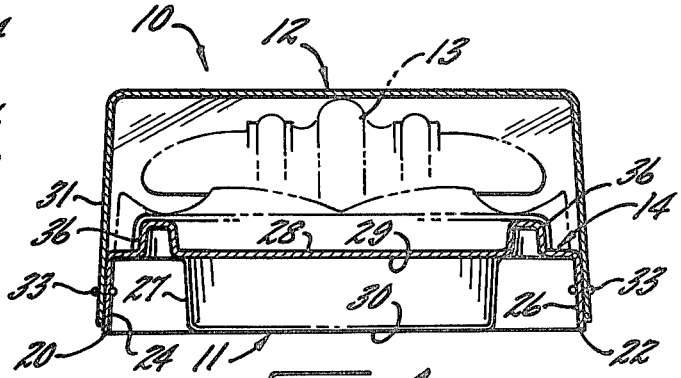
FIG. 4 is an enlarged sectional view taken along the line 4—4 in FIG. 1.

In the present instance, the base 11 is rectangular with rounded corners and the peripheral section 14 outwardly from the extreme edges 19, 20, 21 and 22 (FIGS. 3 and 4) of the base. The section 14 is generally U-shaped in cross section with the outer sides 23, 24, 25 and 26 being slightly inclined and forming a continuous wall around the margin of the base. The inner sides or wall 27 of the section 14 also are inclined and the two walls are joined by an integral top portion 28 which is parallel with the plane a. The inner wall 27 defines a well 29 which is closed by a flat bottom 30 integral with the lower edge of the inner wall and lying in the plane a. It will be understood that the sides 23, 24, 25 and 26, the top portion 28, the inner wall 27 and the bottom wall 30 are formed as a unitary molded piece of plastic material. With the edges 19, 20, 21 and 22, the lower edge of the inner wall 27 and the bottom wall 30 all lying in the plane a together with the rigidity afforded by the peripheral section 14, the base 11 has a structural integrity sufficient to support comparatively heavy articles even when stacked in a horizontal position as shown in FIG. 6.

Figure 5:
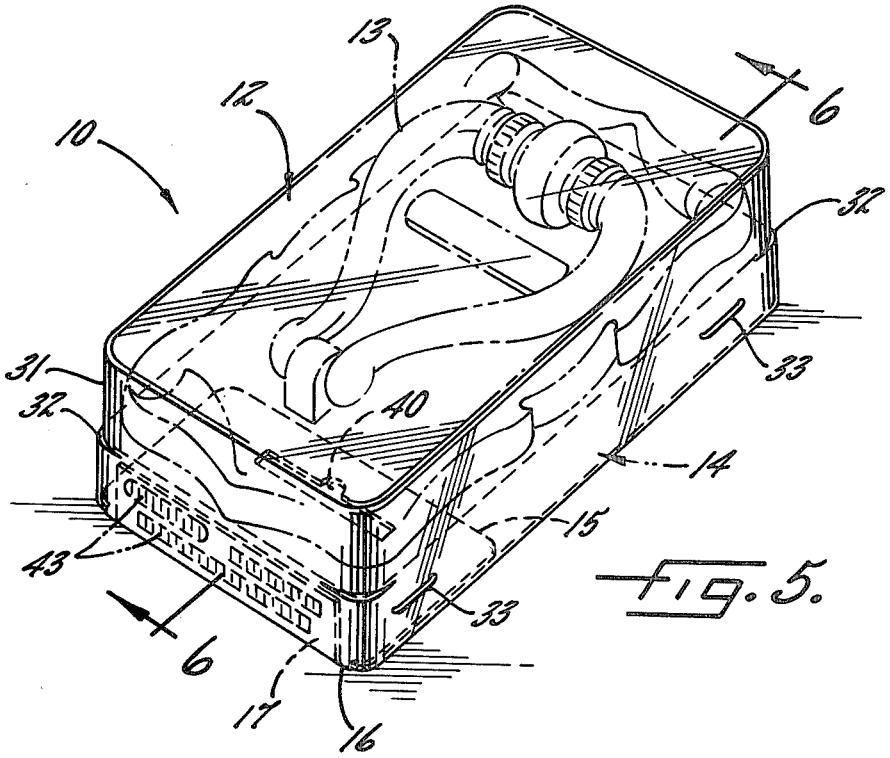
FIG. 5 is a perspective view of the package in condition for stacking.

The transparent cover 12 is rectangularly shaped similar to the base 11 and is formed with four depending flanges which constitute a continuous skirt 31 for the sides of the cover. The skirt is inclined outwardly to match the inclining of the sides 23, 24, 25 and 26 of the peripheral section 14 and is telescoped over this section. Above the section 14, the corners of the skirt have a greater radius of curvature to provide shoulder 32 (FIGS. 1 and 5) which seat on the section and locate the cover. With the cover in place, the skirt is secured to the side walls 23, 24, 25 and 26 of the peripheral section by any suitable means such as heat sealing or, as illustrated in the drawings, by staples 33.

The peripheral section 14 and the well 29 are capable of coacting in various ways to receive and support articles of varying shapes and sizes. Thus, the article may be entirely within the well or supported above the well by the section 14 or supported by the section with a portion in the well. In the case of the door knocker 13 illustrated in the drawings, the knocker is supported on the peripheral section and bridges the well with the mounting screws 34 and an instruction sheet 35 (FIG. 3) being packaged in the well. Projections 36 may be formed on the base 11 at such locations and of such size and shape as to conform with the article 13 and coact with the latter to help prevent the article from shifting in the package. In the form illustrated, there are four such projections 36 at the corners of the top portion 28 of the peripheral section 14. The projections are frustoconical in shape and are received in the corners of a recess 37 formed in the back side of the door knocker 13.

The invention contemplates a novel cooperation of the tab 15 and the base 11 with the use of the fold line 16 so that the tab may be used as a means for hanging the package 10 for display or, alternatively, it may be moved to a position where it is concealed when a plurality of packages are laid horizontally and stacked vertically. To this end, the tab is molded integrally with the base and projects outwardly from one edge of the base, herein the edge 19, so that the tab normally lies in the plane a. The fold line 16 (FIG. 2) is formed along the intersection of the inner edge of the tab and the base so that the tab may be folded about this line through 180 degrees to lie under the base and essentially in the plane a (see FIGS. 5 and 6). In the present instance, the fold line is formed adjacent the edge 19 whereby the tab normally projects out from lower edge of the side 23 of the peripheral section 14. The tab is rectangular and of the same width as the wall 23 with rounded corners 38 adjacent the fold line 16 and rounded outer corners 39. The means on the tab for hanging the package is an elongated slot 40 extending transversely of the tab to receive a suitable hanger 41 (FIG. 1).

Herein, the means 17 for identifying the packaged article 13 is a flexible sheet, such as a paper label, which covers at least a portion of the face of the tab 15, spans the fold line 16 and covers at least a portion of the side 23 of the peripheral section 14 of the base 11. Preferably, the sheet is made of paper and is suitably bonded to the tab and the side 23, the size of the sheet being such that it stops short of the edges of the tab and the side. Identifying indicia 42 is printed on the portion of the sheet covering the tab and similar indicia 43 is printed on the portion covering the side 23 so that the indicia 42 identify the article 13 when the packages are hung by the tab and the indicia 43 identify the article when the packages are stacked.

Figure 1:
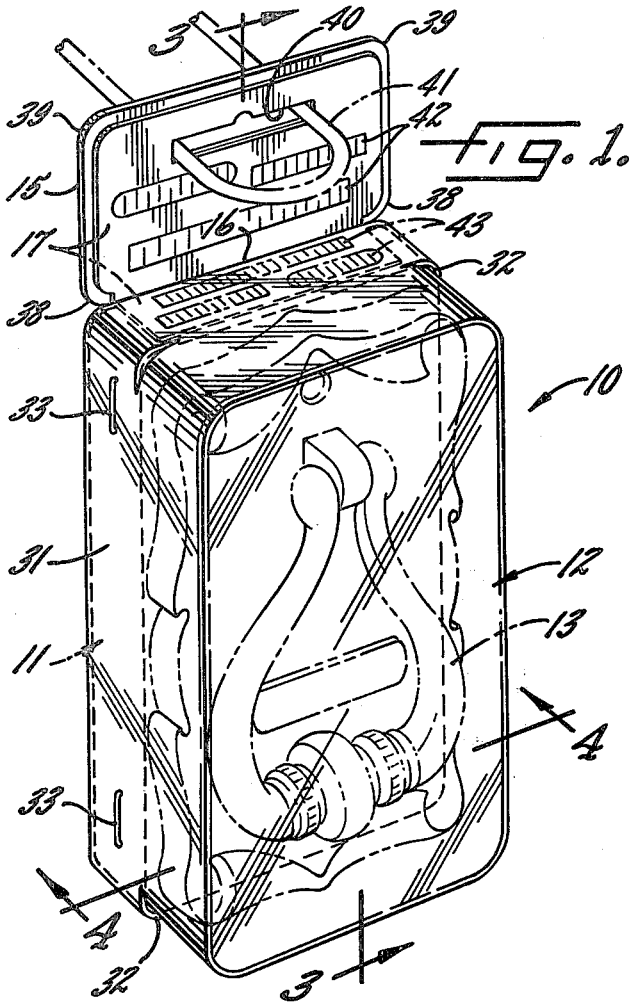
FIG. 1 is a perspective view of a package embodying my invention and illustrating the package as hung from a display rack.
Figure 2:
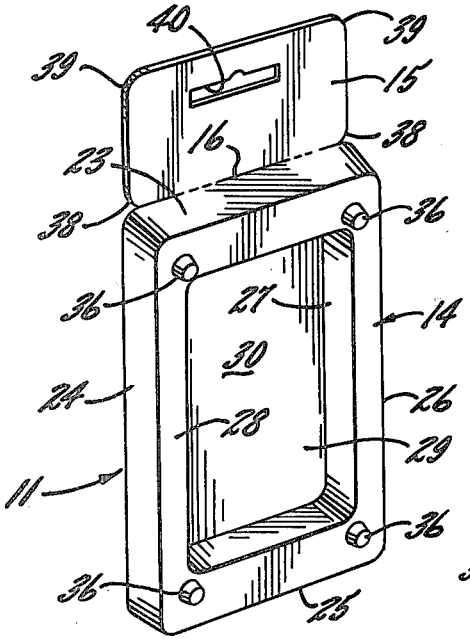
FIG. 2 is a perspective view on a reduced scale of the base of the package.

It will be observed that the packages 10 may readily be displayed either by hanging them by the tabs 15 as shown in FIG. 1 or by stacking them as illustrated in FIG. 6. In either fashion of display, the articles 13 are well supported and are readily identified by either the indicia 42 or the indicia 43 on the sheet 17.

We claim:

1. A package comprising, (1) a molded plastic base having, a. a rectangular member including four peripheral edges and a central portion, b. said peripheral edges and said central portion lying in a common plane, c. a peripheral section projecting up from said plane and extending completely around said member adjacent said edges, said section defining a well in the central portion of said base, d. a flat tab extending from one of said edges at one side of said member and normally lying in said plane, said tab being no wider than said one side, and e. a fold line connecting said tab and said member at said one edge to permit the tab to be folded under said member, f. said well and said peripheral section coacting to receive an article to be packaged, (2) a rectangular transparent cover having four flanges, one depending from each edge of said cover and each engaging the outer side of said peripheral edge portion, (3) means joining the flanges on said cover to the corresponding sides of said peripheral edge portion, (4) means on said tab for hanging the tab whereby each package may be hung by the tab or, alternatively, a plurality of packages may be stacked one on top of the other with the tab of each package folded under said member of the corresponding package, and (5) a flexible sheet extending across said fold line and having a first portion overlying said tab and a second portion overlying said adjacent side of said peripheral section, said first portion being secured to said tab and said second portion being secured to said adjacent side and both portions bearing identifying indicia whereby said article is identified both when the package is hung and when the package is stacked.

2. A package as defined in claim 1 in which said peripheral section includes projections for holding said article.

* * * * *